US011926921B2

(12) United States Patent
Ueno et al.

(10) Patent No.: US 11,926,921 B2
(45) Date of Patent: Mar. 12, 2024

(54) METHOD OF PRODUCING SURFACE-TREATED STEEL SHEET AND SURFACE-TREATED STEEL SHEET

(71) Applicant: JFE STEEL CORPORATION, Tokyo (JP)

(72) Inventors: Takashi Ueno, Tokyo (JP); Mikito Suto, Tokyo (JP); Yoichiro Yamanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 143 days.

(21) Appl. No.: 17/594,502

(22) PCT Filed: Feb. 18, 2020

(86) PCT No.: PCT/JP2020/006236

§ 371 (c)(1),
(2) Date: Oct. 20, 2021

(87) PCT Pub. No.: WO2020/217663

PCT Pub. Date: Oct. 29, 2020

(65) Prior Publication Data

US 2022/0205124 A1 Jun. 30, 2022

(30) Foreign Application Priority Data

Apr. 23, 2019 (JP) ..... 2019-082262

(51) Int. Cl.
*C25D 9/06* (2006.01)
*C23C 28/00* (2006.01)
*C25D 9/08* (2006.01)

(52) U.S. Cl.
CPC ..... *C25D 9/08* (2013.01); *C23C 28/32* (2013.01); *C25D 9/06* (2013.01)

(58) Field of Classification Search
None
See application file for complete search history.

(56) References Cited

U.S. PATENT DOCUMENTS 8,679,643 B2 3/2014 Date
11,021,806 B2 6/2021 Yamanaka et al.
(Continued)

FOREIGN PATENT DOCUMENTS

CN 101652503 A 2/2010
CN 102959136 A 3/2013
(Continued)

OTHER PUBLICATIONS

English translation WO 2015/001598 (Year: 2015).*
(Continued)

*Primary Examiner* — Stefanie S Wittenberg
(74) *Attorney, Agent, or Firm* — KENJA IP LAW PC

(57) ABSTRACT

A method of producing a surface-treated steel sheet, comprising: subjecting a steel sheet having a Sn coating or plating layer to an anodic electrolytic treatment in an alkaline aqueous solution to form a Sn oxide layer; and then subjecting the steel sheet to a cathodic electrolytic treatment in an aqueous solution containing zirconium ions to form a layer containing zirconium oxide, wherein the Sn coating or plating layer has a Sn coating weight of 0.1 g/m$^2$ to 20.0 g/m$^2$, the Sn oxide layer has, at a point in time when the Sn oxide layer is formed, a reduction current peak within a potential range of −800 mV to −600 mV and an electric quantity of a reduction current in the potential range of 1.5 mC/cm$^2$ to 10.0 mC/cm$^2$, and the layer containing zirconium oxide has a Zr coating weight of 0.1 mg/m$^2$ to 50.0 mg/m$^2$.

3 Claims, 1 Drawing Sheet

(56) References Cited

U.S. PATENT DOCUMENTS

| | | | |
|---|---|---|---|
| 2010/0119867 | A1 | 5/2010 | Date |
| 2013/0089751 | A1 | 4/2013 | Hirano et al. |
| 2019/0301043 | A1 | 10/2019 | Yamanaka et al. |

FOREIGN PATENT DOCUMENTS

| | | | |
|---|---|---|---|
| CN | 105358737 | A | 2/2016 |
| CN | 105814240 | A | 7/2016 |
| CN | 109154097 | A | 1/2019 |
| EP | 2143822 | A1 | 1/2010 |
| EP | 3467154 | A1 | 4/2019 |
| EP | 3508617 | A1 | 7/2019 |
| JP | 2015158005 | A | 9/2015 |
| JP | WO2016076073 | A1 | 4/2017 |
| JP | 2018035394 | A | 3/2018 |
| JP | 2018135569 | A | 8/2018 |
| JP | WO2018190412 | A1 | 12/2019 |
| KR | 1020090111882 | A | 10/2009 |
| TW | 201531572 | A | 8/2015 |
| WO | 2015001598 | A1 | 1/2015 |
| WO | 2016076073 | A1 | 5/2016 |
| WO | 2018042980 | A1 | 3/2018 |
| WO | 2018190412 | A1 | 10/2018 |
| WO | 2019039044 | A1 | 2/2019 |

OTHER PUBLICATIONS

English translation JP 2015158005 (Year: 2015).*

Apr. 22, 2022, the Extended European Search Report issued by the European Patent Office in the corresponding European Patent Application No. 20794716.9.

Apr. 14, 2020, International Search Report issued in the International Patent Application No. PCT/JP2020/006236.

Mar. 2, 2021, Notification of Reasons for Refusal issued by the Japan Patent Office in the corresponding Japanese Patent Application No. 2020-523032 with English language Concise Statement of Relevance.

Sep. 16, 2020, Office Action issued by the Taiwan Intellectual Property Office in the corresponding Taiwanese Patent Application No. 109106861 with English language Search Report.

Sep. 14, 2022, Office Action issued by the Korean Intellectual Property Office in the corresponding Korean Patent Application No. 10-2021-7033976 with English language concise statement of relevance.

Feb. 3, 2023, Office Action issued by the China National Intellectual Property Administration in the corresponding Chinese Patent Application No. 202080030387.9 with English language search report.

* cited by examiner

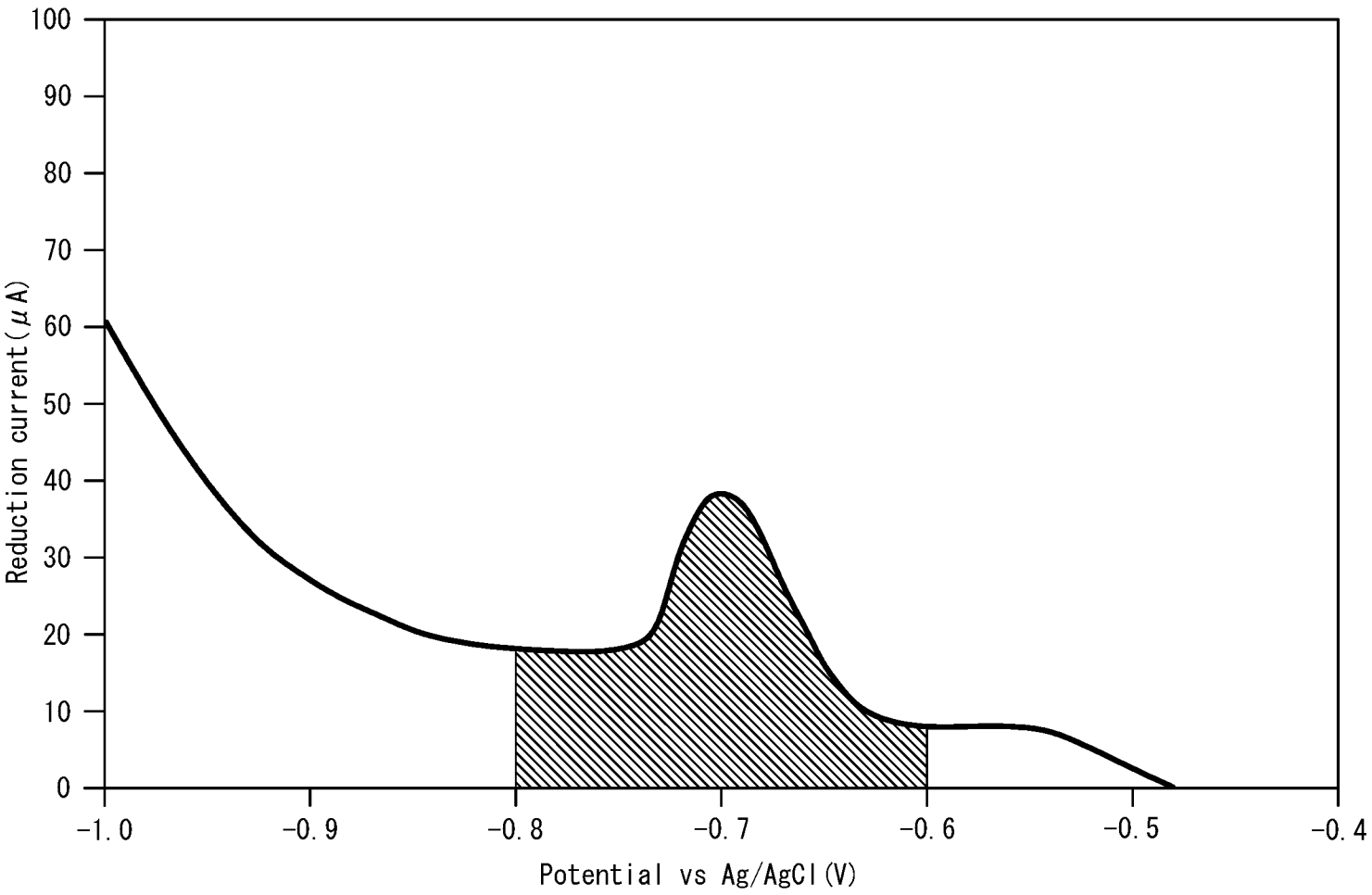
Reduction current (μA)
100
90
80
70
60
50
40
30
20
10
0
-1.0
-0.9
-0.8
-0.7
-0.6
-0.5
-0.4
Potential vs Ag/AgCl (V)

METHOD OF PRODUCING SURFACE-TREATED STEEL SHEET AND SURFACE-TREATED STEEL SHEET

TECHNICAL FIELD

This disclosure relates to a method of producing a surface-treated steel sheet, and, in particular, to a surface-treated steel sheet having excellent sulfide staining resistance and paint adhesion property and suitably usable as a steel sheet for containers. This disclosure also relates to a surface-treated steel sheet produced by the method.

BACKGROUND

Sn plated or coated steel sheets are widely used as the material for containers such as beverage cans and food cans because they are excellent in corrosion resistance and Sn does not harm the human body. Sn plated or coated steel sheets used as steel sheets for containers are usually subjected to chemical conversion treatment. As the chemical conversion treatment, chromating treatment has been used for many years because of its excellent sulfide staining resistance and paint adhesion property.

On the other hand, in the field of surface treatment of steel sheets, due to the growing awareness of the environment and safety in recent years, it is required that not only the final product does not contain hexavalent chromium, but also the manufacturing process does not use hexavalent chromium. Therefore, in the field of steel sheets for containers, there is a demand for a surface treatment that can replace chromating treatment.

Under these circumstances, various surface treatment methods have been proposed for application to Sn plated or coated steel sheets in place of chromating treatment.

For example, JP2018-135569A (PTL 1) and WO2018/190412A (PTL 2) propose surface treatment methods in which a cathodic electrolytic treatment in an aqueous solution containing zirconium ions is applied to a Sn plated or coated steel sheet, followed by an anodic electrolytic treatment in an aqueous solution containing an electrolyte such as sodium hydrogen carbonate.

CITATION LIST

Patent Literature

PTL 1: JP2018-135569A
PTL 2: WO2018/190412A

SUMMARY

Technical Problem

According to PTLs 1 and 2, surface-treated steel sheets produced by the methods proposed in PTLs 1 and 2 are believed to have excellent paint adhesion property and sulfide staining resistance. However, in PTLs 1 and 2, the evaluation of sulfide staining resistance was conducted under mild conditions compared to the actual environment when the surface-treated steel sheet is used as a container (can), and the sulfide staining resistance was insufficient under conditions closer to the actual container operating environment. Therefore, there is a need for a surface treatment method that can achieve both sulfide staining resistance and paint adhesion property at a higher level.

It would thus be helpful to provide a surface-treated steel sheet capable of achieving both sulfide staining resistance and paint adhesion property at a high level.

Solution to Problem

As a result of diligent study to address the above issues, the present inventors made the following findings.

In the methods proposed in PTLs 1 and 2, cathodic electrolysis is performed to form a zirconium oxide layer, and then anodic electrolysis is performed to form a layer containing zirconium oxide and Sn oxide. However, as described above, it is not possible for these methods to produce a surface-treated steel sheet that can achieve both sulfide staining resistance and paint adhesion property at a high level.

In contrast, by sequentially performing the following treatments (1) and (2), a surface-treated steel sheet having both sulfide staining resistance and paint adhesion property at a high level can be obtained.

(1) An anodic electrolytic treatment in an alkaline aqueous solution is performed to form a Sn oxide layer with controlled quantity and morphology on the Sn plated or coated steel sheet.

(2) Then, a cathodic electrolytic treatment in an aqueous solution containing zirconium ions is performed to form a layer containing zirconium oxide with a controlled coating weight is formed on the Sn oxide layer.

Although the mechanism is not clear, the reason is considered to be that the crystal structure and crystal orientation of the Sn oxide layer were optimized by controlling the morphology and quantity of the Sn oxide layer appropriately before forming the zirconium oxide layer, making it possible to achieve both sulfide staining resistance and paint adhesion property at a high level.

The present disclosure was completed based on these discoveries, and primary features thereof are as follows.

1. A method of producing a surface-treated steel sheet, comprising: subjecting a steel sheet having a Sn coating or plating layer on at least one side to an anodic electrolytic treatment in an alkaline aqueous solution to form a Sn oxide layer on the Sn coating or plating layer; and then subjecting the steel sheet to a cathodic electrolytic treatment in an aqueous solution containing zirconium ions to form a layer containing zirconium oxide on the Sn oxide layer, wherein the Sn coating or plating layer has a Sn coating weight of 0.1 $g/m^2$ to 20.0 $g/m^2$ per one side of the steel sheet, the Sn oxide layer has, at a point in time when the Sn oxide layer is formed, a reduction current peak within a potential range of −800 mV to −600 mV vs. a saturated KCl—Ag/AgCl reference electrode in a current-potential curve obtained by sweeping potential from an immersion potential toward lower potential at a sweeping speed of 1 mV/sec in an aqueous 0.001 N hydrogen bromide solution at 25° C. purged with an inert gas, and an electric quantity of a reduction current in the potential range of 1.5 $mC/cm^2$ to 10.0 $mC/cm^2$, and the layer containing zirconium oxide has a Zr coating weight of 0.1 $mg/m^2$ to 50.0 $mg/m^2$ per one side of the steel sheet.

2. The method of producing a surface-treated steel sheet according to the aspect 1, comprising: subjecting the steel sheet having a Sn coating or plating layer on at least one side to a cathodic electrolytic treatment in the alkaline aqueous solution prior to the anodic electrolytic treatment.

3. A surface-treated steel sheet produced by the method as recited in the aspect 1 or 2.

Advantageous Effect

According to the present disclosure, it is possible to provide a surface-treated steel sheet capable of achieving both sulfide staining resistance and paint adhesion property at a high level. The surface-treated steel sheet obtained by the method disclosed herein can be suitably used for various applications, including steel sheets for containers.

BRIEF DESCRIPTION OF THE DRAWING

FIG. 1 illustrates an example of a current-potential curve of a Sn oxide layer.

DETAILED DESCRIPTION

The following provides details of a method of carrying out the present disclosure.

First Embodiment

A method of producing a surface-treated steel sheet according to one of the embodiments of the present disclosure comprises: subjecting a steel sheet having a Sn coating or plating layer on at least one side to an anodic electrolytic treatment in an alkaline aqueous solution; and then subjecting the steel sheet to a cathodic electrolytic treatment in an aqueous solution containing zirconium ions. This embodiment will be described in detail below.

[Steel Sheet Having a Sn Coating or Plating Layer]

In the present disclosure, a steel sheet having a Sn coating or plating layer on at least one side (which may be referred to hereinafter as a "Sn plated or coated steel sheet") is used as an object to which surface treatment is applied. In other words, a plated or coated steel sheet comprising a steel sheet (base steel sheet) and a Sn coating or plating layer formed on at least one side of the steel sheet can be used.

(Steel Sheet)

Any steel sheet can be used as the above-described steel sheet without being particularly limited. For example, an ultra-low carbon steel sheet or a low-carbon steel sheet can be used as the steel sheet. The production method of a steel sheet is not particularly limited, and a steel sheet produced by any method can be used. For example, a general production process including hot rolling, pickling, cold rolling, annealing, and temper rolling can be used.

(Sn Coating or Plating Layer)

The Sn coating or plating layer need only be provided on at least one side of the steel sheet, yet may be provided on both sides. The Sn coating or plating layer need only cover at least a part of the steel sheet, yet may cover the entire surface on which the Sn coating or plating layer is provided. The Sn coating or plating layer may be a continuous layer or a discontinuous layer. The discontinuous layer is, for example, a layer having an island-like structure.

The Sn coating or plating layer also includes a partially alloyed one. For example, the Sn coating or plating layer may be partially a Sn alloy layer as a result of being subjected to hot melt treatment following the Sn plating or coating. Examples of the Sn alloy layer include an Fe—Sn alloy layer and an Fe—Sn—Ni alloy layer.

For example, by heating and melting Sn through electrical resistance heating or the like after the Sn plating or coating, a part of the Sn coating or plating layer on the steel sheet side can be made into an Fe—Sn alloy layer. In addition, by applying Sn plating or coating on a steel sheet having a Ni-containing layer on its surface and then heating and melting Sn through electrical resistance heating or the like, a part of the Sn coating or plating layer on the steel sheet side can be made into one or both of an Fe—Sn—Ni alloy layer and an Fe—Sn alloy layer.

Sn Coating Weight: 0.1 $g/m^2$ to 20.0 $g/m^2$

The Sn coating weight per one side of the steel sheet in the Sn coating or plating layer is 0.1 $g/m^2$ or more and 20.0 $g/m^2$ or less. When the Sn coating weight is within this range, the surface-treated steel sheet has excellent appearance and corrosion resistance. In particular, from the viewpoint of further improving these properties, it is preferable to set the Sn coating weight to 0.2 $g/m^2$ or more. In addition, from the viewpoint of further improving the formability, it is more preferable to set the Sn coating weight to 1.0 $g/m^2$ or more.

The Sn coating weight can be measured by surface analysis using X-ray fluorescence. In this case, a calibration curve for the amount of metallic Sn is identified beforehand using a sample with a known amount of metallic Sn, and the calibration curve is used to determine the Sn coating weight.

The formation of the Sn coating or plating layer is not particularly limited and can be carried out by any method such as electroplating or hot dip coating. When the Sn coating or plating layer is formed by electroplating, the plating bath can be freely selected. For example, the plating bath may be a phenol sulfonic acid Sn plating bath, a methanesulfonic acid Sn plating bath, or a halogen-based Sn plating bath.

After the Sn coating or plating layer is formed, reflow treatment may be performed. When reflow treatment is performed, the Sn coating or plating layer is heated to a temperature at or above the melting point of Sn (231.9° C.) to form an alloy layer such as an Fe—Sn alloy layer below (on the steel sheet side of) the coating or plating layer of Sn alone. If reflow treatment is omitted, a Sn plated or coated steel sheet having a coating or plating layer of Sn alone is obtained.

(Ni-Containing Layer)

As the Sn plated or coated steel sheet, a plated or coated steel sheet having a Ni-containing layer in addition to the Sn coating or plating layer can be used. As the Ni-containing layer, any layer containing nickel can be used, and, for example, one or both of a Ni layer and a Ni alloy layer can be used. The Ni layer is, for example, a Ni coating or plating layer. The Ni alloy layer is, for example, a Ni—Fe alloy layer. It is also possible to form an Fe—Sn—Ni alloy layer, an Fe—Sn alloy layer, or the like below (on the steel sheet side of) the coating or plating layer of Sn alone by forming a Sn coating or plating layer on the Ni-containing layer and then performing reflow treatment.

The method of forming the Ni-containing layer is not particularly limited, and any method such as electroplating can be used. When forming a Ni—Fe alloy layer as the Ni-containing layer, the Ni—Fe alloy layer can be formed by forming a Ni layer on the surface of the steel sheet by electroplating or the like, and then subjecting the steel sheet to annealing.

Although the amount of Ni in the Ni-containing layer is not particularly limited, it is preferable that the amount of metallic Ni equivalent per one side be 50 $mg/m^2$ or more and 2000 $mg/m^2$ or less. Within the above range, it is not only more excellent in sulfide staining resistance but also more advantageous in terms of cost.

[Anodic Electrolytic Treatment]

In the present disclosure, it is important to perform an anodic electrolytic treatment prior to a cathodic electrolytic treatment in an aqueous solution containing zirconium ions to be described later. Through the anodic electrolytic treatment of the Sn plated or coated steel sheet in an alkaline aqueous solution, a part of the Sn coating or plating layer is oxidized and a Sn oxide layer containing tin oxide is formed on the Sn coating or plating layer.

(Alkaline Aqueous Solution)

As the alkaline aqueous solution, any alkaline aqueous solution can be used without being particularly limited. The alkaline aqueous solution may contain one or more optional electrolytes. Any electrolyte may be contained without being particularly limited. However, when an alkali metal hydroxide such as sodium hydroxide or potassium hydroxide is used, the Sn oxide layer is mainly composed of SnO (SnO-dominated). Therefore, from the viewpoint of controlling the quantity and morphology of the Sn oxide layer, as described below, it is preferable to use carbonate. In other words, it is preferable to use a carbonate aqueous solution as the alkaline aqueous solution. The carbonate is preferably an alkali metal carbonate, and more preferably sodium carbonate. The pH of the alkaline aqueous solution is not particularly limited. However, from the viewpoint of controlling the quantity and morphology of the Sn oxide layer, as described below, the pH is preferably 8 or higher. It is preferably 12 or lower.

The concentration of electrolyte in the alkaline aqueous solution is not particularly limited. However, from the viewpoint of forming a continuous and dense Sn oxide layer on the surface of the Sn plated or coated steel sheet, the concentration is preferably 1 g/L or more. It is preferably 30 g/L or less. It is more preferably 5 g/L or more. It is more preferably 20 g/L or less.

The temperature of the alkaline aqueous solution at the time of the anodic electrolytic treatment is not particularly limited. However, from the viewpoint of making the amount of the Sn oxide layer formed suitable and further improving the sulfide staining resistance, the temperature is preferably 10° C. or higher. It is preferably 70° C. or lower. It is more preferably 20° C. or higher. It is more preferably 60° C. or lower.

The electric quantity density at the time of the anodic electrolytic treatment is not particularly limited. It suffices for the electric quantity density to be adjusted such that the resulting Sn oxide layer satisfies the conditions described below. However, the optimum electric quantity density is affected by extremely diverse conditions, such as the condition of the Sn plated or coated steel sheet to be treated, the resistance of the rectifier, wiring, and other components used, and the agitation of the aqueous solution, and varies depending on the equipment used. Therefore, in the present disclosure, it is important to control the quantity and morphology of the resulting Sn oxide layer as described below, instead of directly specifying the electrolysis conditions. In general, it is preferable to adjust the electric quantity density when performing the anodic electrolysis treatment within the range of 0.7 $C/dm^2$ to 15.0 $C/dm^2$.

In order to obtain a surface-treated steel sheet with both sulfide staining resistance and paint adhesion property at a high level, it is important to form a Sn oxide layer whose quantity and morphology are appropriately controlled by the anodic electrolysis in the alkaline aqueous solution. Specifically, the Sn oxide layer needs to have, at a point in time when it is formed, a reduction current peak within a potential range of −800 mV to −600 mV vs. a saturated KCl—Ag/AgCl reference electrode in a current-potential curve obtained by sweeping potential from an immersion potential toward lower potential at a sweeping speed of 1 mV/sec in an aqueous 0.001 N hydrogen bromide solution at 25° C. purged with an inert gas, and an electric quantity of a reduction current in the potential range of 1.5 $mC/cm^2$ to 10.0 $mC/cm^2$.

The reasons for the above limitations are explained below. Unless otherwise stated, potentials in the following description represent potentials with respect to a saturated KCl—Ag/AgCl reference electrode.

Current Peak

In the current-potential curve measured under the above conditions, if a reduction current peak is observed in the range of −600 mV to −500 mV, the peak is mainly due to the reduction current of SnO. On the other hand, if the reduction current peak is observed in a lower (i.e., more negative) range of −800 mV to −600 mV, the peak is considered to originate from the reduction of $SnO_2$ and a Sn—Fe or Sn—Fe—Ni alloy layer oxide film. If the Sn oxide layer is mainly composed of SnO, the sulfide staining resistance deteriorates. In contrast, when the Sn oxide layer is mainly composed of $SnO_2$ and a Sn—Fe or Sn—Fe—Ni alloy layer oxide film, the sulfide staining resistance is improved. This is considered to be because $SnO_2$ and the Sn—Fe or Sn—Fe—Ni alloy layer oxide film act as a barrier against sulfide staining, whereas SnO provides an initiation point for nucleation of SnS, which is the cause of staining, and promotes sulfide staining. Therefore, the formation of the Sn oxide layer having a reduction current peak within the potential range of −800 mV to −600 mV in the current-potential curve can improve the sulfide staining resistance.

Electric Quantity of Reduction Current

However, even if the reduction current peak is observed within the above potential range, sufficient sulfide staining resistance cannot be obtained if the amount of Sn oxide showing reduction current within the potential range is small. Accordingly, the amount of the Sn oxide layer is 1.5 $mC/cm^2$ or more, preferably 2.0 $mC/cm^2$ or more, and more preferably 2.5 $mC/cm^2$ or more, in terms of the electric quantity of the reduction current in the potential range of −800 mV to −600 mV. On the other hand, if the Sn oxide layer is too thick, cohesive failure of the Sn oxide layer, which provides an initiation point for exfoliation of the painting layer, is likely to occur, resulting in reduced paint adhesion property. Therefore, the amount of the Sn oxide layer is 10.0 $mC/cm^2$ or less, and preferably 8.0 $mC/cm^2$ or less, in terms of the electric quantity of the reduction current in the potential range of −800 mV to −600 mV.

The above current-potential curve can be measured by immersing the steel sheet at the point in time when the Sn oxide layer is formed in an aqueous 0.001 N hydrogen bromide solution purged with an inert gas and sweeping potential from an immersion potential toward lower potential at a sweeping speed of 1 mV/sec. For example, Ar can be used as the inert gas. A saturated KCl—Ag/AgCl electrode is used as the reference electrode and a platinum plate as the counter electrode.

An example of the current-potential curve of the Sn oxide layer measured under the above conditions is illustrated in FIG. 1. In the current-potential curve illustrated in FIG. 1, there is a reduction current peak in the potential range of −800 mV to −600 mV. The electric quantity of the reduction current in the potential range of −800 mV to −600 mV described above is the electric quantity (electric quantity density) of the reduction current added up in the range indicated by the shaded line in FIG. 1.

By controlling the conditions of anodic electrolysis treatment (such as electric quantity density) to satisfy those identified above, a surface-treated steel sheet having both excellent sulfide staining resistance and paint adhesion property can be obtained. After the above anodic electrolysis treatment, the subsequent cathodic electrolysis treatment is performed. Prior to the cathodic electrolysis treatment, however, a water washing treatment may be optionally performed.

[Cathodic Electrolytic Treatment]

Then, the steel sheet is subjected to a cathodic electrolytic treatment in an aqueous solution containing zirconium ions to form a layer containing zirconium oxide on the Sn oxide layer. Hereinafter, a layer containing zirconium oxide may be referred to as a zirconium oxide layer.

Zr Coating Weight: 0.1 $mg/m^2$ to 50.0 $mg/m^2$

A zirconium oxide layer is a layer that acts as a barrier against sulfide staining. In order to obtain excellent sulfide staining resistance, the Zr coating weight needs to be 0.1 $mg/m^2$ or more per one side of the steel sheet, and it is preferably 0.5 $mg/m^2$ or more, and more preferably 1.0 $mg/m^2$ or more. On the other hand, if the zirconium oxide layer is too thick, cohesive failure of the zirconium oxide layer, which provides an initiation point for cohesive failure, is more likely to occur, resulting in lower paint adhesion property. Therefore, the Zr coating weight needs to be 50.0 $mg/m^2$ or less per one side of the steel sheet, and it is preferably 45.0 $mg/m^2$ or less, and more preferably 40.0 $mg/m^2$ or less.

The layer containing zirconium oxide is formed by cathodic electrolytic treatment of the steel sheet on which the Sn oxide layer has been formed, while immersed in an aqueous solution containing zirconium ions. With electrolytic treatment, a uniform layer can be formed in a shorter time than with immersion treatment because of the forced charge transfer by energizing, surface cleaning by hydrogen generation at the steel sheet interface, and deposition promotion by pH increase.

The method of preparing the aqueous solution containing zirconium ions is not particularly limited. However, the aqueous solution containing zirconium ions can be prepared, for example, by dissolving a zirconium-containing compound as a zirconium ion source in water. The water may be any water including, but not limited to, distilled water and deionized water.

As the zirconium-containing compound, any compound capable of supplying zirconium ions can be used. As the zirconium-containing compound, for example, it is preferable to use a zirconium complex such as $H_2ZrF_6$. Zr is present in the electrolyte as $Zr^{4+}$ due to the increase in pH at the surface of the cathode. These Zr ions further react to form zirconium oxide, forming a layer. There is no problem if the aqueous solution contains one or more selected from the group consisting of fluorine ions, nitrate ions, ammonium ions, phosphate ions, and sulfate ions. When the aqueous solution contains both nitrate ions and ammonium ions, the process can be carried out in a short time, from a few seconds to several tens of seconds, which is extremely advantageous for industrial use. Therefore, it is preferable that the aqueous solution contains both nitrate ions and ammonium ions in addition to zirconium ions.

The concentration of zirconium ions in the aqueous solution is not particularly limited. However, for example, it is preferably 100 ppm or more. It is preferably 4000 ppm or less. If the aqueous solution contains fluorine ions, the concentration of fluorine ions is preferably 120 ppm or more. It is preferably 4000 ppm or less. If the aqueous solution contains phosphate ions, the concentration of phosphate ions is preferably 50 ppm or more. It is preferably 5000 ppm or less. If the aqueous solution contains ammonium ions, the concentration of ammonium ions is preferably 20000 ppm or less. If the aqueous solution contains nitrate ions, the concentration of nitrate ions is preferably 20000 ppm or less. If the aqueous solution contains sulfate ions, the concentration of sulfate ions is preferably 20000 ppm or less.

The temperature of the aqueous solution when performing the cathodic electrolysis is not particularly limited. However, for example, it is preferably 10° C. or higher. It is preferably 50° C. or lower. The cathodic electrolysis at 50° C. or lower enables the formation of a dense and uniform layer structure made from very fine particles. In addition, by setting the temperature of the solution at 50° C. or lower, the generation of defects, cracks, microcracks, and the like in the layer to be formed can be suppressed, and the decrease in paint adhesion property can be further prevented. In addition, the efficiency of layer formation can be improved by setting the temperature of the solution to 10° C. or higher. In addition, if the temperature of the solution is set to 10° C. or higher, cooling of the solution is unnecessary even when the outside temperature is high, such as in summer, which is economical.

The pH of the aqueous solution containing zirconium ions is not particularly limited. However, it is preferably 3 or higher. It is preferably 5 or lower. If the pH is 3 or higher, the generation efficiency of zirconium oxide can be further improved. If the pH is 5 or lower, a large amount of precipitation can be prevented from occurring in the solution, and good continuous productivity can be obtained.

For example, nitric acid or ammonia water may be added to the aqueous solution containing zirconium ions for the purpose of adjusting the pH and improving the electrolysis efficiency.

The current density in cathodic electrolysis is not particularly limited. However, for example, it is preferably 0.05 $A/dm^2$ or more. It is preferably 50 $A/dm^2$ or less. If the current density is 0.05 $A/dm^2$ or more, the generation efficiency of zirconium oxide is improved. As a result, the layer containing zirconium oxide can be more stably formed, and the sulfide staining resistance and anti-yellowing property can be further improved. When the current density is 50 $A/dm^2$ or less, the generation efficiency of zirconium oxide can be moderated, making it possible to suppress the generation of coarse zirconium oxide with poor adhesion. The current density is more preferably 1 $A/dm^2$ or more. It is more preferably 10 $A/dm^2$ or less.

The electrolysis time in the cathodic electrolysis treatment is not particularly limited and can be adjusted appropriately according to the current density to obtain the above-identified Zr coating weight.

The current pattern in the above cathodic electrolysis treatment may be continuous or intermittent. The relationship between the aqueous solution and the steel sheet in performing the cathodic electrolysis is not particularly limited and may be relatively stationary or moving. However, from the viewpoint of promoting the reaction and improving uniformity, it is preferable to perform cathodic electrolysis while moving the steel sheet and the aqueous solution relatively. For example, cathodic electrolysis is performed continuously while the steel sheet is passed through a treatment tank in which an aqueous solution containing zirconium ions is situated. Consequently, the steel sheet and the aqueous solution can be moved relative to each other.

When cathodic electrolysis is performed while the steel sheet and the aqueous solution are moved relative to each other, it is preferable that the relative flow velocity between the aqueous solution and the steel sheet be 50 m/min or more. If the relative flow velocity is 50 m/min or more, the pH at the steel sheet surface where hydrogen is generated as a result of energizing can be further made uniform, and the formation of coarse zirconium oxide can be effectively suppressed. The upper limit of the relative flow velocity is not particularly limited.

When fluorine ions are contained in the cathode electrolyte, the fluorine ions are incorporated into the zirconium oxide layer together with the zirconium oxide. The fluorine ions incorporated in the zirconium oxide layer do not affect the primary paint adhesion property, but degrade the secondary paint adhesion property and corrosion resistance. This is believed to be caused by the elution of fluorine ions in the zirconium oxide layer into water vapor or corrosion solution, causing the fluorine ions to decompose the bond between the zirconium oxide layer and the organic layer such as a film or paint, or to corrode the steel sheet.

Therefore, in order to decrease the amount of fluoride ions in the zirconium oxide layer, it is preferable to perform a washing treatment after the cathodic electrolytic treatment. Examples of the cleaning treatment include immersion treatment and spray treatment. The amount of fluoride ions in the zirconium oxide layer can be further reduced by increasing the temperature of the cleaning water used in the cleaning treatment and increasing the treatment time of the cleaning treatment. To reduce the amount of fluoride ions in the zirconium oxide layer, it is preferable to perform immersion or spray treatment with cleaning water at 40° C. or higher for 0.5 seconds or more. If the temperature of the cleaning water is lower than 40° C. or the treatment time is shorter than 0.5 seconds, the amount of fluoride ions in the zirconium oxide layer cannot be reduced and the above-described characteristics cannot be demonstrated.

In addition to the fluorine ions, when phosphate ions, ammonium ions, nitrate ions, or the like are present in the cathode electrolyte, these ions may also be incorporated into the zirconium oxide layer together with the zirconium oxide. These ions incorporated in the zirconium oxide layer can be removed by performing the above-described cleaning treatment. Similarly, in the case of reducing phosphate ions, ammonium ions, nitrate ions, or sulfate ions in the zirconium oxide layer, the amount of phosphate ions, ammonium ions, or nitrate ions can be further reduced by increasing the temperature of the cleaning water or increasing the treatment time.

Fluorine ions, phosphate ions, ammonium ions, and nitrate ions are preferably removed from the zirconium oxide layer as much as possible by the immersion or spray treatment. However, it is not necessary to remove all of them, and it is acceptable if any remain.

Second Embodiment

The method of producing a surface-treated steel sheet in another embodiment of the present disclosure includes: subjecting the steel sheet having a Sn coating or plating layer on at least one side to a cathodic electrolytic treatment in the alkaline aqueous solution prior to the anodic electrolytic treatment. In other words, a cathodic electrolytic treatment in the alkaline aqueous solution, an anodic electrolytic treatment in the alkaline aqueous solution, and a cathodic electrolytic treatment in an aqueous solution containing zirconium ions are sequentially applied to the steel sheet having a Sn coating or plating layer on at least one side.

By subjecting the steel sheet having a Sn coating or plating layer on at least one side to a cathodic electrolytic treatment in the alkaline aqueous solution prior to the anodic electrolytic treatment, any natural oxide film present on the surface of the Sn coating or plating layer can be removed. From the viewpoint of controlling the quantity and morphology of the Sn oxide layer, it is preferable to perform a cathodic electrolytic treatment to remove the natural oxide film, and subsequently an anodic electrolytic treatment to form a Sn oxide layer.

The cathodic electrolytic treatment may be performed in the same alkaline aqueous solution as the anodic electrolytic treatment. That is, the cathodic and anodic electrolytic treatments are performed while the steel sheet having a Sn coating or plating layer on at least one side is immersed in the alkaline aqueous solution. From the viewpoint of preventing the formation of a natural oxide film, it is preferable that the cathodic and anodic electrolytic treatments be continuously performed while the steel sheet is immersed in the alkaline aqueous solution, i.e., without exposing it to the air.

The electric quantity density in the cathodic electrolytic treatment is not particularly limited. However, it is preferably 0.5 $C/dm^2$ or more. It is preferably 5.0 $C/dm^2$ or less.

The second embodiment can be the same as the first embodiment, except that the cathodic electrolytic treatment is performed prior to the anodic electrolytic treatment.

EXAMPLES

The present disclosure will be described in detail below with reference to examples. However, the present disclosure is not limited to the disclosed examples.

Example 1

First, surface-treated steel sheets were prepared by anodic and cathodic electrolytic treatments as follows.

[Formation of Sn Coating or Plating Layer]

First, a steel sheet (T4 substrate sheet) with a thickness of 0.22 mm and a temper of T−4 was subjected to pretreatment, followed by electroplating with Sn in a phenol sulfonic acid bath, and hot melt treatment. As the pretreatment, electrolytic degreasing, water washing, acid cleaning by immersion in dilute sulfuric acid, and water washing were performed sequentially. The coating weight of Sn plating was varied by changing the electrolysis time during the electroplating with Sn. The Sn coating weight per one side of each obtained Sn plated steel sheet was measured by X-ray fluorescence. The measurement results are listed in Table 1.

[Anodic Electrolytic Treatment]

Then, each obtained Sn plated steel sheet was immersed in an alkaline aqueous solution and subjected to an anodic electrolytic treatment to form a Sn oxide layer on the plating layer. As the alkaline aqueous solution, aqueous solutions containing the electrolytes listed in Table 1 at the concentrations presented in Table 1 were used. The temperature of the alkaline aqueous solutions when the anodic electrolytic treatment was carried out and the electric quantity density of the electrolytic treatment are listed together in Table 1. After the completion of the anodic electrolytic treatment, each steel sheet was removed from the alkaline solution and washed in water.

The process up to this point was carried out on two steel sheet samples for each condition. One of the two samples obtained was directly subjected to the cathodic electrolytic treatment described below to produce a surface-treated steel sheet. The other was used for the measurement of the current-potential curve described below to evaluate the state of the formed Sn oxide layer.

(Measurement of the Current-Potential Curve)

In order to evaluate the state of the Sn oxide layer at the point in time when it is formed, the current-potential curve was measured using the sample after the anodic electrolysis treatment. The current-potential curve was measured by immersing the steel sheet at the point in time when the Sn oxide layer was formed in an aqueous 0.001 N hydrogen bromide solution at 25° C., which had been purged with Ar, and sweeping potential from an immersion potential toward lower potential at a sweeping speed of 1 mV/sec. The measurement was carried out within one hour after the completion of the anodic electrolytic treatment and subsequent water washing. A saturated KCl—Ag/AgCl electrode was used as the reference electrode and a platinum plate as the counter electrode. The presence or absence of a reduction current peak within the potential range of −800 mV to −600 mV in the obtained current-potential curves and the electrical quantities of the reduction current within the potential range are listed in Table 1. The measurements were carried out without stirring the aqueous hydrogen bromide solutions.

[Cathodic Electrolytic Treatment]

Each steel sheet after the anodic electrolytic treatment was subjected to a cathodic electrolytic treatment in an aqueous solution containing zirconium ions to form a layer containing zirconium oxide on the Sn oxide layer formed by the anodic electrolytic treatment. As the aqueous solution containing zirconium ions, aqueous solutions containing zirconium fluoride were used. The amounts of the components contained in the aqueous solutions are listed in Table 2. The temperature of the aqueous solutions was set at 35° C. and the pH was adjusted to be 3 or higher and 5 or lower. The Zr coating weight was controlled by adjusting the current density and electrolysis time. After the completion of the cathodic electrolytic treatment, the steel sheets were immersed in distilled water at 20° C. to 40° C. for 0.5 seconds to 5 seconds, then immersed in distilled water at 80° C. to 90° C. for 0.5 seconds to 3 seconds, and then dried at room temperature using a blower.

The Zr coating weight of each obtained layer containing zirconium oxide was measured by X-ray fluorescence. The measurement results are listed in Table 1.

For comparison, surface-treated steel sheets were prepared under conditions simulating those of the examples in PTLs 1 and 2 (corresponding to Comparative Examples Nos. 26 and 27). The specific conditions were as follows.

No. 26

The conditions of Example No. B3 in PTL 1 were adopted. Specifically, the following treatments (1) and (2) were sequentially performed on a Sn plated steel sheet. No anodic electrolytic treatment was carried out before the cathodic electrolytic treatment in item (1) below.

(1) Cathodic Electrolytic Treatment

Electrolyte: an aqueous solution containing zirconium fluoride

Zirconium ion concentration: 1400 ppm

Current density: 3.0 A/m$^2$

Flow velocity: 200 m/min pH: 4.0

Bath temperature: 35° C.

[Anodic Electrolytic Treatment]

Electrolyte: an aqueous sodium hydrogen carbonate solution

Electrical conductivity: 2.0 S/m

Bath temperature: 25° C.

Electric quantity density: 0.4 C/dm$^2$

Current density: 0.4 A/dm$^2$

No. 27

The conditions of Example No. A9 in PTL 2 were adopted. Specifically, the following treatments (1) and (2) were sequentially performed on a Sn plated steel sheet. No anodic electrolytic treatment was carried out before the cathodic electrolytic treatment in item (1) below.

(1) Cathodic Electrolytic Treatment

Electrolyte: treatment solution B in Table 2 pH: 3 or higher and 5 or lower

Bath temperature: 35° C.

[Anodic Electrolytic Treatment]

Electrolyte: an aqueous sodium hydrogen carbonate solution

Zirconium ion concentration: 10 ppm

Electrical conductivity: 2.0 S/m

Bath temperature: 25° C.

In Comparative Examples Nos. 26 and 27, no anodic electrolytic treatment was performed before the cathodic electrolytic treatment. Therefore, the current-potential curve in an aqueous 0.001 N hydrogen bromide solution was measured immediately after the formation of the Sn plating layer. Other measurement conditions were the same as in the other examples.

Then, each of the obtained surface-treated steel sheets was evaluated for sulfide staining resistance and paint adhesion property by the method described below. The evaluation results are listed in Table 3.

(Sulfide Staining Resistance)

A commercial epoxy resin paint for cans was applied to the surface of each obtained surface-treated steel sheet at a dry mass of 60 mg/dm$^2$, then baked at a temperature of 200° C. for 10 minutes, and then left at room temperature for 24 hours. The steel sheet was then cut to a predetermined size to prepare a test piece.

On the other hand, as an aqueous solution for testing, an aqueous solution containing 7.1 g/L of disodium hydrogen phosphate anhydrous, 3.0 g/L of sodium dihydrogen phosphate anhydrous, and 6.0 g/L of L-cysteine hydrochloride was prepared, boiled for 1 hour, and then the volume reduced by evaporation was replenished with pure water. Each obtained aqueous solution was poured into a fluoroplastic pressure-resistant and heat-resistant container, and the corresponding test piece was immersed in the aqueous solution. The lids of the containers were closed and sealed, and the containers were subjected to retorting at 131° C. for 120 minutes.

The sulfide staining resistance was evaluated from the appearance of each surface-treated steel sheet after the retorting. The steel sheets were judged as "excellent" if the appearance did not change at all before and after the test, "good" if a staining of 20 area % or less occurred, or "poor" if a staining of more than 20 area % occurred. Those steel sheets rated "excellent" or "good" were considered to have passed the test as having excellent sulfide staining resistance in practical use.

(Paint Adhesion Property)

A commercial epoxy resin paint for cans was applied to the surface of each obtained surface-treated steel sheet at a dry mass of 60 mg/dm$^2$, then baked at a temperature of 200° C. for 10 minutes, and then left at room temperature for 24 hours. Each steel sheet was then cut to a predetermined size. Subsequently, 100 squares were made on the surface of each cut steel sheet with a cutter knife (such that the area of one square was 1 mm$^2$) to make a test piece.

Each test piece was subjected to retorting at 121° C. for 60 minutes while immersed in pure water. After the retorting, tape peeling was performed in the region where the squares were made, and the paint adhesion property was evaluated from the paint peeling rate. The paint peeling rate was judged as "excellent" when it was 0.0% or more and less than 10.0%, "good" when it was 10.0% or more and less than 60.0%, or "poor" when it was 60.0% or more. Those test pieces rated "excellent" or "good" were considered to have passed the test as having excellent paint adhesion property in practical use.

As can be seen from the results in Table 1, the surface-treated steel sheets obtained by the method satisfying the conditions of the present disclosure were all excellent in sulfide staining resistance and paint adhesion property. In contrast, those comparative examples in which the electric quantity required for reduction in the range of −800 mV to −600 mV was less than 1.5 mC/cm$^2$ and in which the Zr coating weight was less than 0.1 mg/m$^2$ had inferior sulfide staining resistance. In addition, those comparative examples in which the electric quantity required for reduction in the range of −800 mV to −600 mV was more than 10.0 mC/cm$^2$ and in which the Zr coating weight was more than 50.0 mg/m$^2$ had inferior paint adhesion property.

In Comparative Example No. 26, the electric quantity required for reduction in the range of −800 mV to −600 mV immediately after the formation of the Sn plating layer was less than 1.5 mC/cm$^2$, and the sulfide staining resistance was inferior. Similarly, in Comparative Example No. 27, the electric quantity required for reduction in the range of −800 mV to −600 mV immediately after the formation of the Sn plating layer was less than 1.5 mC/cm$^2$, and the sulfide staining resistance was inferior.

TABLE 1

| | Sn plating | | | Anodic electrolytic treatment | | | | |
|---|---|---|---|---|---|---|---|---|
| No. | Reflow treatment | Ni coating weight [mg/m$^2$] | Sn coating weight [g/m$^2$] | Electrolyte | Concentration [g/L] | Temp. [° C.] | Electric quantity density [C/dm$^2$] | State of Sn oxide layer Reduction current peak |
| 1 | performed | — | 1.0 | sodium carbonate | 10 | 20 | 1.5 | observed |
| 2 | performed | — | 11.2 | sodium carbonate | 20 | 55 | 5.2 | observed |
| 3 | performed | — | 8.4 | sodium carbonate | 5 | 60 | 10.5 | observed |
| 4 | performed | — | 5.6 | sodium carbonate | 8 | 30 | 13.0 | observed |
| 5 | performed | — | 2.8 | sodium carbonate | 15 | 40 | 1.3 | observed |
| 6 | performed | — | 2.8 | sodium carbonate | 13 | 25 | 1.1 | observed |
| 7 | performed | — | 2.8 | sodium carbonate | 9 | 50 | 0.9 | observed |
| 8 | performed | — | 5.6 | sodium carbonate | 10 | 25 | 0.6 | observed |
| 9 | performed | — | 2.8 | sodium carbonate | 11 | 45 | 14.0 | observed |
| 10 | performed | — | 2.8 | sodium carbonate | 18 | 30 | 18.0 | observed |
| 11 | performed | — | 2.8 | sodium carbonate | 16 | 35 | 1.4 | observed |
| 12 | performed | — | 2.8 | sodium carbonate | 12 | 40 | 1.8 | observed |
| 13 | performed | — | 2.8 | sodium carbonate | 13 | 55 | 5.3 | observed |
| 14 | performed | — | 5.6 | sodium carbonate | 15 | 60 | 1.5 | observed |
| 15 | performed | — | 5.6 | sodium carbonate | 10 | 70 | 1.5 | observed |
| 16 | performed | — | 5.6 | sodium carbonate | 7 | 10 | 10.5 | observed |
| 17 | performed | — | 5.6 | sodium carbonate | 1 | 20 | 10.6 | observed |
| 18 | performed | — | 2.8 | sodium carbonate | 30 | 20 | 13.0 | observed |
| 19 | performed | — | 5.6 | sodium hydroxide | 28 | 50 | 15.0 | not observed |
| 20 | performed | — | 2.8 | sodium hydroxide | 4 | 20 | 10.5 | not observed |
| 21 | performed | — | 11.2 | sodium hydroxide | 15 | 70 | 13.1 | not observed |
| 22 | performed | — | 2.8 | sodium hydroxide | 8 | 15 | 16.2 | not observed |
| 23 | performed | 70 | 0.9 | sodium carbonate | 5 | 35 | 1.8 | observed |
| 24 | not performed | — | 2.8 | sodium carbonate | 10 | 45 | 2.3 | observed |
| 25 | not performed | 80 | 0.8 | sodium carbonate | 20 | 50 | 4.3 | observed |
| 26 | performed | — | 2.8 | — | — | — | — | not observed |
| 27 | performed | — | 2.8 | — | — | — | — | not observed |

| | Cathodic electrolytic treatment | | | | | |
|---|---|---|---|---|---|---|
| | State of Sn oxide layer | | Zr | Evaluation | | |
| No. | Electric quantity [mC/cm$^2$] | Treatment solution | coating weight [mg/m$^2$] | Paint adhesion property | Sulfide staining resistance | Remarks |
| 1 | 3.2 | A | 1.3 | excellent | excellent | Example |
| 2 | 4.3 | B | 38.9 | excellent | excellent | Example |
| 3 | 6.8 | C | 22.3 | excellent | excellent | Example |
| 4 | 7.9 | D | 12.5 | excellent | excellent | Example |
| 5 | 2.5 | D | 8.3 | excellent | excellent | Example |
| 6 | 2.2 | C | 4.8 | excellent | excellent | Example |
| 7 | 1.8 | B | 16.4 | excellent | good | Example |
| 8 | 1.4 | C | 21.2 | excellent | poor | Comparative Example |
| 9 | 8.2 | D | 13.3 | good | excellent | Example |
| 10 | 10.3 | A | 37.5 | poor | excellent | Comparative Example |

TABLE 1-continued

| | | | | | | |
|---|---|---|---|---|---|---|
| 11 | 2.8 | B | 48.3 | good | excellent | Example |
| 12 | 3.5 | C | 53.2 | poor | excellent | Comparative Example |
| 13 | 4.3 | D | 0.8 | excellent | good | Example |
| 14 | 3.2 | A | 0.0 | excellent | poor | Comparative Example |
| 15 | 1.9 | A | 18.2 | excellent | good | Example |
| 16 | 1.7 | C | 13.3 | excellent | good | Example |
| 17 | 1.7 | C | 26.6 | excellent | good | Example |
| 18 | 1.6 | B | 22.1 | excellent | good | Example |
| 19 | 0.3 | A | 11.3 | excellent | poor | Comparative Example |
| 20 | 0.8 | B | 20.5 | excellent | poor | Comparative Example |
| 21 | 0.5 | C | 5.2 | excellent | poor | Comparative Example |
| 22 | 0.4 | D | 35.8 | excellent | poor | Comparative Example |
| 23 | 3.8 | C | 9.6 | excellent | excellent | Example |
| 24 | 3.9 | C | 8.8 | excellent | excellent | Example |
| 25 | 4.2 | C | 6.6 | excellent | excellent | Example |
| 26 | 0.2 | — | 5.0 | excellent | poor | Comparative Example |
| 27 | 0.1 | — | 5.0 | excellent | poor | Comparative Example |

TABLE 2

| Treatment | Composition (ppm) | | | | |
|---|---|---|---|---|---|
| solution | $Zr^{4+}$ | $PO_4^{3-}$ | $F^-$ | $NO_3^{3-}$ | $NH_4^+$ |
| A | 3000 | — | 4000 | — | — |
| B | 1500 | — | 2000 | 3000 | 2000 |
| C | 2000 | 950 | 2000 | 1600 | 1000 |
| D | 2000 | 950 | 2000 | 7000 | 2500 |

Example 2

Then, surface-treated steel sheets were prepared by the same procedure as in the first embodiment, except that a cathodic electrolytic treatment was performed prior to the anodic electrolytic treatment.

[Cathodic Electrolytic Treatment+Anodic Electrolytic Treatment]

Specifically, each Sn plated steel sheet obtained by the same method as in Example 1 was immersed in an alkaline aqueous solution and subjected to a cathodic electrolytic treatment at the electric quantity density listed in Table 3. Then, a Sn oxide layer was formed on the Sn plating layer by an anodic electrolytic treatment at the electric quantity density listed in Table 3 while the steel sheet was immersed in the alkaline aqueous solution. The electrolytes contained in the alkaline aqueous solutions used, their concentrations, and temperatures are listed in Table 3. After the completion of the anodic electrolytic treatment, each steel sheet was removed from the alkaline solution and washed in water.

Then, current-potential curves were measured and cathodic electrolytic treatments in aqueous solutions containing zirconium ions were performed in the same procedure as in Example 1 to obtain surface-treated steel sheets. The sulfide staining resistance and paint adhesion property of each obtained surface-treated steel sheet were evaluated by the same procedure as in Example 1. The evaluation results are listed in Table 3.

As can be seen from the results in Table 3, the surface-treated steel sheets obtained by the method satisfying the conditions of the present disclosure were all excellent in sulfide staining resistance and paint adhesion property. In contrast, those surface-treated steel sheets in the comparative examples were inferior in either sulfide staining resistance or paint adhesion property.

TABLE 3

| | Sn plating | | | Cathodic Electrolytic Treatment + Anodic Electrolytic Treatment | | | | |
|---|---|---|---|---|---|---|---|---|
| | | | | Alkaline aqueous solution | | | Cathodic electrolytic treatment Electric quantity | Anodic electrolytic treatment Electric quantity |
| No. | Reflow treatment | Ni coating weight [mg/m²] | Sn coating weight [g/m²] | Electrolyte | Concentration [g/L] | Temp. [° C.] | Density [C/dm²] | Density [C/dm²] |
| 28 | performed | — | 1.0 | sodium carbonate | 5 | 20 | 2.0 | 0.7 |
| 29 | performed | — | 2.8 | sodium carbonate | 10 | 30 | 1.8 | 2.5 |
| 30 | performed | — | 2.8 | sodium carbonate | 15 | 35 | 3.2 | 3.9 |
| 31 | performed | — | 2.8 | sodium carbonate | 10 | 40 | 4.3 | 0.6 |
| 32 | performed | — | 2.8 | sodium carbonate | 8 | 50 | 2.3 | 0.6 |
| 33 | performed | — | 5.6 | sodium carbonate | 5 | 30 | 1.3 | 1.3 |
| 34 | performed | — | 5.6 | sodium carbonate | 10 | 35 | 1.2 | 10.3 |
| 35 | performed | — | 5.6 | sodium carbonate | 10 | 40 | 3.3 | 8.6 |
| 36 | performed | — | 5.6 | sodium carbonate | 15 | 45 | 0.8 | 11.2 |
| 37 | performed | — | 8.4 | sodium carbonate | 12 | 50 | 0.6 | 8.0 |
| 38 | performed | — | 8.4 | sodium carbonate | 7 | 55 | 2.3 | 0.8 |
| 39 | performed | — | 8.4 | sodium carbonate | 11 | 25 | 1.5 | 0.8 |
| 40 | performed | — | 8.4 | sodium carbonate | 13 | 25 | 4.8 | 0.7 |
| 41 | performed | — | 11.2 | sodium carbonate | 16 | 30 | 5.0 | 0.7 |
| 42 | performed | — | 11.2 | sodium carbonate | 9 | 35 | 0.5 | 2.8 |
| 43 | performed | — | 11.2 | sodium carbonate | 10 | 20 | 2.3 | 2.5 |
| 44 | performed | — | 11.2 | sodium carbonate | 20 | 25 | 2.2 | 7.6 |
| 45 | performed | 70 | 0.9 | sodium carbonate | 15 | 40 | 2.1 | 4.3 |

TABLE 3-continued

| | | | | | | | | |
|---|---|---|---|---|---|---|---|---|
| 46 | not performed | 80 | 0.8 | sodium carbonate | 14 | 45 | 2.0 | 0.7 |
| 47 | performed | — | 2.8 | sodium carbonate | 9 | 25 | 3.5 | 0.7 |
| 48 | performed | — | 2.8 | sodium carbonate | 6 | 50 | 1.5 | 0.2 |
| 49 | performed | — | 2.8 | sodium carbonate | 10 | 20 | 2.2 | 14.6 |
| 50 | performed | — | 2.8 | sodium carbonate | 12 | 15 | 3.2 | 19.3 |
| 51 | performed | — | 2.8 | sodium carbonate | 13 | 20 | 2.6 | 0.8 |
| 52 | performed | — | 2.8 | sodium carbonate | 14 | 35 | 3.9 | 1.0 |
| 53 | performed | — | 2.8 | sodium carbonate | 13 | 20 | 2.6 | 0.8 |
| 54 | performed | — | 2.8 | sodium carbonate | 14 | 35 | 2.0 | 2.1 |
| 55 | performed | — | 2.8 | sodium hydroxide | 15 | 30 | 4.2 | 10.3 |
| 56 | performed | — | 2.8 | sodium hydroxide | 10 | 25 | 1.7 | 12.6 |
| 57 | performed | — | 2.8 | sodium hydroxide | 5 | 25 | 1.6 | 15.3 |
| 58 | performed | — | 2.8 | sodium hydroxide | 6 | 25 | 2.6 | 0.9 |

| | State of Sn oxide layer | | Cathodic electrolytic treatment | Zr | Evaluation | | |
|---|---|---|---|---|---|---|---|
| No. | Reduction current peak | Electric quantity [mC/cm$^2$] | Treatment solution | coating weight [mg/m$^2$] | Paint adhesion property | Sulfide staining resistance | Remarks |
| 28 | observed | 3.1 | A | 13.6 | excellent | excellent | Example |
| 29 | observed | 4.2 | D | 15.8 | excellent | excellent | Example |
| 30 | observed | 5.3 | A | 7.2 | excellent | excellent | Example |
| 31 | observed | 2.8 | B | 6.3 | excellent | excellent | Example |
| 32 | observed | 2.6 | C | 3.2 | excellent | excellent | Example |
| 33 | observed | 3.8 | D | 1.2 | excellent | excellent | Example |
| 34 | observed | 7.2 | A | 20.3 | excellent | excellent | Example |
| 35 | observed | 6.3 | B | 32.5 | excellent | excellent | Example |
| 36 | observed | 7.9 | C | 10.3 | excellent | excellent | Example |
| 37 | observed | 6.2 | D | 5.6 | excellent | excellent | Example |
| 38 | observed | 3.6 | A | 39.3 | excellent | excellent | Example |
| 39 | observed | 3.3 | B | 22.6 | excellent | excellent | Example |
| 40 | observed | 3.2 | C | 16.3 | excellent | excellent | Example |
| 41 | observed | 2.6 | D | 15.8 | excellent | excellent | Example |
| 42 | observed | 4.6 | A | 26.6 | excellent | excellent | Example |
| 43 | observed | 4.3 | B | 30.1 | excellent | excellent | Example |
| 44 | observed | 6.2 | C | 19.7 | excellent | excellent | Example |
| 45 | observed | 5.5 | C | 16.4 | excellent | excellent | Example |
| 46 | observed | 3.3 | C | 28.1 | excellent | excellent | Example |
| 47 | observed | 1.9 | A | 7.6 | excellent | good | Example |
| 48 | observed | 1.3 | B | 33.5 | excellent | poor | Comparative Example |
| 49 | observed | 9.3 | C | 25.4 | good | excellent | Example |
| 50 | observed | 10.5 | D | 20.3 | poor | excellent | Comparative Example |
| 51 | observed | 3.5 | A | 47.3 | good | excellent | Example |
| 52 | observed | 4.3 | B | 52.6 | poor | excellent | Comparative Example |
| 53 | observed | 3.6 | C | 0.3 | excellent | good | Example |
| 54 | observed | 4.2 | D | 0.0 | excellent | poor | Comparative Example |
| 55 | not observed | 0.2 | A | 15.3 | excellent | poor | Comparative Example |
| 56 | not observed | 0.5 | B | 14.6 | excellent | poor | Comparative Example |
| 57 | not observed | 0.3 | C | 29.6 | excellent | poor | Comparative Example |
| 58 | not observed | 0.4 | D | 34.8 | excellent | poor | Comparative Example |

The invention claimed is:

1. A method of producing a surface-treated steel sheet, comprising:

subjecting a steel sheet having an Sn coating or an Sn plating layer on at least one side to an anodic electrolytic treatment in an alkaline aqueous solution to form an Sn oxide layer on the Sn coating or the Sn plating layer; and then subjecting the steel sheet to a cathodic electrolytic treatment in an aqueous solution containing zirconium ions to form a layer containing zirconium oxide on the Sn oxide layer, wherein the Sn coating or the Sn plating layer has an Sn coating weight of 0.1 g/m$^2$ to 20.0 g/m$^2$ per one side of the steel sheet, the Sn oxide layer has, at a point in time when the Sn oxide layer is formed, a reduction current peak within a potential range of −800 mV to −600 mV vs. a saturated KCl-Ag/AgCl reference electrode in a current-potential curve obtained by sweeping potential from an immersion potential toward lower potential at a sweeping speed of 1 mV/sec in an aqueous 0.001 N hydrogen bromide solution at 25° C. purged with an inert gas, and an electric quantity of a reduction current in the potential range of 1.5 mC/cm$^2$ to 10.0 mC/cm$^2$, and the layer containing zirconium oxide has a Zr coating weight of 0.1 mg/m$^2$ to 50.0 mg/m$^2$ per one side of the steel sheet.

2. The method of producing a surface-treated steel sheet according to claim 1, comprising: subjecting the steel sheet having the Sn coating or the Sn plating layer on the at least one side to a cathodic electrolytic treatment in the alkaline aqueous solution prior to the anodic electrolytic treatment.

3. The method of producing a surface-treated steel sheet according to claim 1, wherein the aqueous solution containing zirconium ions is free of titanium ion.

* * * * *